US008126355B2

(12) United States Patent
Aruga et al.

(10) Patent No.: US 8,126,355 B2
(45) Date of Patent: Feb. 28, 2012

(54) DEVELOPING DEVICE WITH SEAL MEMBER THAT ABUTS TONER CARRIER ROLLER

(75) Inventors: Tomohiro Aruga, Matsumoto (JP); Masahiro Maeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 566 days.

(21) Appl. No.: 12/353,090

(22) Filed: Jan. 13, 2009

(65) Prior Publication Data

US 2009/0185819 A1 Jul. 23, 2009

(30) Foreign Application Priority Data

Jan. 23, 2008 (JP) ..... 2008-012149

(51) Int. Cl.
*G03G 15/08* (2006.01)

(52) U.S. Cl. ..... 399/103; 399/102; 399/273; 399/274; 399/283; 399/284

(58) Field of Classification Search ..... 399/102, 399/103, 273, 274, 283, 284
See application file for complete search history.

(56) References Cited

U.S. PATENT DOCUMENTS

| | | | | |
|---|---|---|---|---|
| 5,592,265 | A | 1/1997 | Sakuraba et al. | |
| 6,335,857 | B1 | 1/2002 | Takimoto et al. | |
| 2007/0212088 | A1 | 9/2007 | Koike et al. | |
| 2008/0298853 | A1 * | 12/2008 | Yamada et al. | 399/284 |
| 2009/0003888 | A1 * | 1/2009 | Kato et al. | 399/279 |

FOREIGN PATENT DOCUMENTS

| | | | |
|---|---|---|---|
| JP | 05-297696 | | 11/1993 |
| JP | 06-075469 | | 3/1994 |
| JP | 08-137257 | | 5/1996 |
| JP | 11025992 | A | 1/1999 |
| JP | 11231639 | A | 8/1999 |
| JP | 11-305545 | | 11/1999 |
| JP | 11-344859 | | 12/1999 |
| JP | 2000049055 | A | 2/2000 |
| JP | 2001134069 | A | 5/2001 |
| JP | 2003-316146 | | 11/2003 |
| JP | 2006259384 | A | 9/2006 |
| JP | 2007-108782 | | 4/2007 |
| JP | 2007121948 | A | 5/2007 |
| JP | 2007-140080 | | 6/2007 |
| JP | 2007140080 | A | 6/2007 |

OTHER PUBLICATIONS

European search report for corresponding European application 09150997.6 lists the references above.

* cited by examiner

*Primary Examiner* — Ryan Walsh
(74) *Attorney, Agent, or Firm* — DLA Piper LLP (US)

(57) ABSTRACT

A developing device, includes: a housing that stores toner inside; a toner carrier roller that is shaped approximately like a cylinder, is mounted to the housing rotatably about a rotational axis, rotates while carrying the toner on a surface thereof to convey the toner to outside of the housing, and is provided, on the surface thereof, with a plurality of convex sections which are regularly arranged and a concave section which surrounds the convex sections, the convex sections including top surfaces that coincide with a part of a curved surface of single cylinder and have electrical conductivity; and a seal member that is arranged in abutting contact with the surface of the toner carrier roller moving from the outside the housing toward the inside the housing at a position downstream of the opposed position in a rotation direction of the toner carrier roller to prevent toner leakage from the housing, a contact surface of the seal member being made of a material located at a position to charge the toner with a polarity opposite to its charging polarity in triboelectric series.

9 Claims, 11 Drawing Sheets

EMBODIMENT

COMPARATIVE EXAMPLE

EMBODIMENT

COMPARATIVE EXAMPLE

FIG. 9

| MATERIAL OF SEAL MEMBER | PARTICLE DIAMETER [μm] | FOGGING | TONER SCATTERING | IMAGE STREAK |
|---|---|---|---|---|
| PTFE (CARBON IS DISPERSED) | 25 | ◎ | ◎ | ◎ |
| | 50 | ○ | ○ | ○ |
| | 100 | × | × | × |
| PE (CARBON IS DISPERSED) | 80 | △ | △ | △ |
| | 150 | × | × | × |

(MEANING OF SYMBOL)
◎ : BEST
○ : GOOD
△ : RATHER POOR
× : POOR

DEVELOPING DEVICE WITH SEAL MEMBER THAT ABUTS TONER CARRIER ROLLER

CROSS REFERENCE TO RELATED APPLICATION

The disclosure of Japanese Patent Application No. 2008-012149 filed on Jan. 23, 2008 including specification, drawings and claims is incorporated herein by reference in its entirety.

BACKGROUND

1. Technical Field

This invention relates to a developing device, an image forming apparatus and an image forming method for conveying toner in a housing to outside the housing by causing a toner carrying roller to carry the toner and thereafter collecting the toner again into the housing.

2. Related Art

In a developing device and an image forming apparatus for conveying toner in a housing to outside the housing by causing a toner carrying roller to carry the toner and thereafter collecting the toner again into the housing, the leakage of the toner to the outside of the housing is prevented by bringing a seal member into contact with a surface of the toner carrying roller. For example, in a developing device disclosed in JP-A-H06-075469, the leakage of toner is prevented by bringing a seal member into contact with a surface of a development sleeve.

In the apparatus constructed as above, the seal member discharges the electric charges of the toner, thereby making the toner easily separable from the toner bearing roller. In return, the seal member itself is electrically charged and electric charges produce repulsive forces to the toner on the toner carrying roller, thereby scattering the toner and weakening an action of the seal member to discharge the toner. Therefore, the toner on the toner carrying roller may not be satisfactorily renewed and problems such as image fogging could occur.

Concerning this, it is disclosed in the above literature that a discharging member or the seal member having a discharging function is directly brought into contact with the development sleeve near an end of the development sleeve to set the neutralizing member or the seal member at the same potential as the development sleeve.

SUMMARY

Since the discharging member or the seal member in the above structure is made of a resin material, in which carbon powder is dispersed, and the electrical conductivity thereof is not very high, it is difficult to allow the electric charges of the seal member to sufficiently escape particularly in a middle part distant from the contact part. As a result, in the above structure, toner scattering and fogging are likely to occur near the middle part in a direction of a rotary shaft of the development sleeve.

An advantage of some aspects of the invention is to provide technology capable of preventing problems such as toner scattering and fogging resulting from the electrical charging of a seal member in a developing device, an image forming apparatus and an image forming method for conveying toner in a housing to outside the housing by causing the toner carrying roller to carry the toner and thereafter collecting the toner again into the housing.

According to a first aspect of the invention, there is provided a developing device, comprising: a housing that stores toner inside; a toner carrier roller that is shaped approximately like a cylinder, is mounted to the housing rotatably about a rotational axis, rotates while carrying the toner on a surface thereof to convey the toner to outside of the housing, and is provided, on the surface thereof, with a plurality of convex sections which are regularly arranged and a concave section which surrounds the convex sections, the convex sections including top surfaces that coincide with a part of a curved surface of single cylinder and have electrical conductivity; and a seal member that is arranged in abutting contact with the surface of the toner carrier roller moving from the outside the housing toward the inside the housing at a position downstream of the opposed position in a rotation direction of the toner carrier roller to prevent toner leakage from the housing, a contact surface of the seal member being made of a material located at a position to charge the toner with a polarity opposite to its charging polarity in triboelectric series.

Conventionally, as a toner carrier roller, a roller whose surface is roughened by a blast process or the like to carry a sufficient amount of toner by increasing the surface area has been generally used. An irregular convexo-concave pattern is formed on the surface of the roller finished with the blast process and, thus, even if a seal member is brought into contact with this surface, the seal member actually touches only projecting parts. Therefore, an action of allowing electric charges of the seal member to escape to the toner bearing roller could be hardly expected.

In contrast, in the invention constructed as above, the top surfaces of the respective convex sections on the toner carrying roller surface form parts of the same cylindrical surface. Accordingly, at each point of time during the rotation of the toner carrying roller, the top surfaces of the respective convex sections at positions facing a contact surface of the seal member come into contact with the seal member at substantially uniform contact pressures. By bringing a multitude of electrically conductive top surfaces of the convex sections with the seal member in this way, electric charges accumulated on the seal member are allowed to stably escape toward the toner bearing roller in the entire area of the seal member. As a result, problems such as toner scattering and fogging resulting from the electrical charging can be effectively prevented by suppressing the electrical charging of the seal member.

According to a second aspect of the invention, there is provided an image forming apparatus, comprising: a latent image carrier that carries an electrostatic latent image; a housing that stores toner inside; a toner carrier roller that is shaped approximately like a cylinder, is mounted to the housing rotatably about a rotational axis, rotates while carrying the toner on a surface thereof to convey the toner to an opposed position to the latent image carrier outside the housing, and is provided, on the surface thereof, with a plurality of convex sections which are regularly arranged and a concave section which surrounds the convex sections, the convex sections including top surfaces that coincide with a part of a curved surface of single cylinder and have electrical conductivity; and a seal member that is arranged in abutting contact with the surface of the toner carrier roller moving from the outside the housing toward the inside the housing at a position downstream of the opposed position in a rotation direction of the toner carrier roller to prevent toner leakage from the housing, a contact surface of the seal member being made of a material located at a position to charge the toner with a polarity opposite to its charging polarity in triboelectric series.

According to a third aspect of the invention, there is provided an image forming method, comprising: causing a toner carrier roller to carry toner stored in a housing, the toner carrier roller being shaped approximately like a cylinder and being provided, on a surface thereof, with a plurality of convex sections which are arranged regularly and a concave section which surrounds the convex sections, the convex sections including top surfaces that coincide with a part of a curved surface of single cylinder and have electrical conductivity; rotating the toner carrier roller to convey the toner to an opposed position facing a latent image carrier that carries an electrostatic latent image, thereby developing the electrostatic latent image with the toner; and bringing a seal member into abutting contact with the surface of the toner carrier roller at a position downstream of the opposed position in a rotation direction of the toner carrier roller, thereby collecting the toner into the housing, a contact surface of the seal member being made of a material located at a position to charge the toner with a polarity opposite to its charging polarity in triboelectric series.

According to these aspects of the invention, similar to the above developing device, the electrical charging of the seal member can be suppressed by allowing the electric charges accumulated on the seal member to stably escape toward the toner bearing roller and problems such as toner scattering and fogging resulting from the electrical charging can be effectively prevented.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 9 is a table showing constitutions and evaluation results of seal members.

DESCRIPTION OF EXEMPLARY EMBODIMENTS

Figure 1:
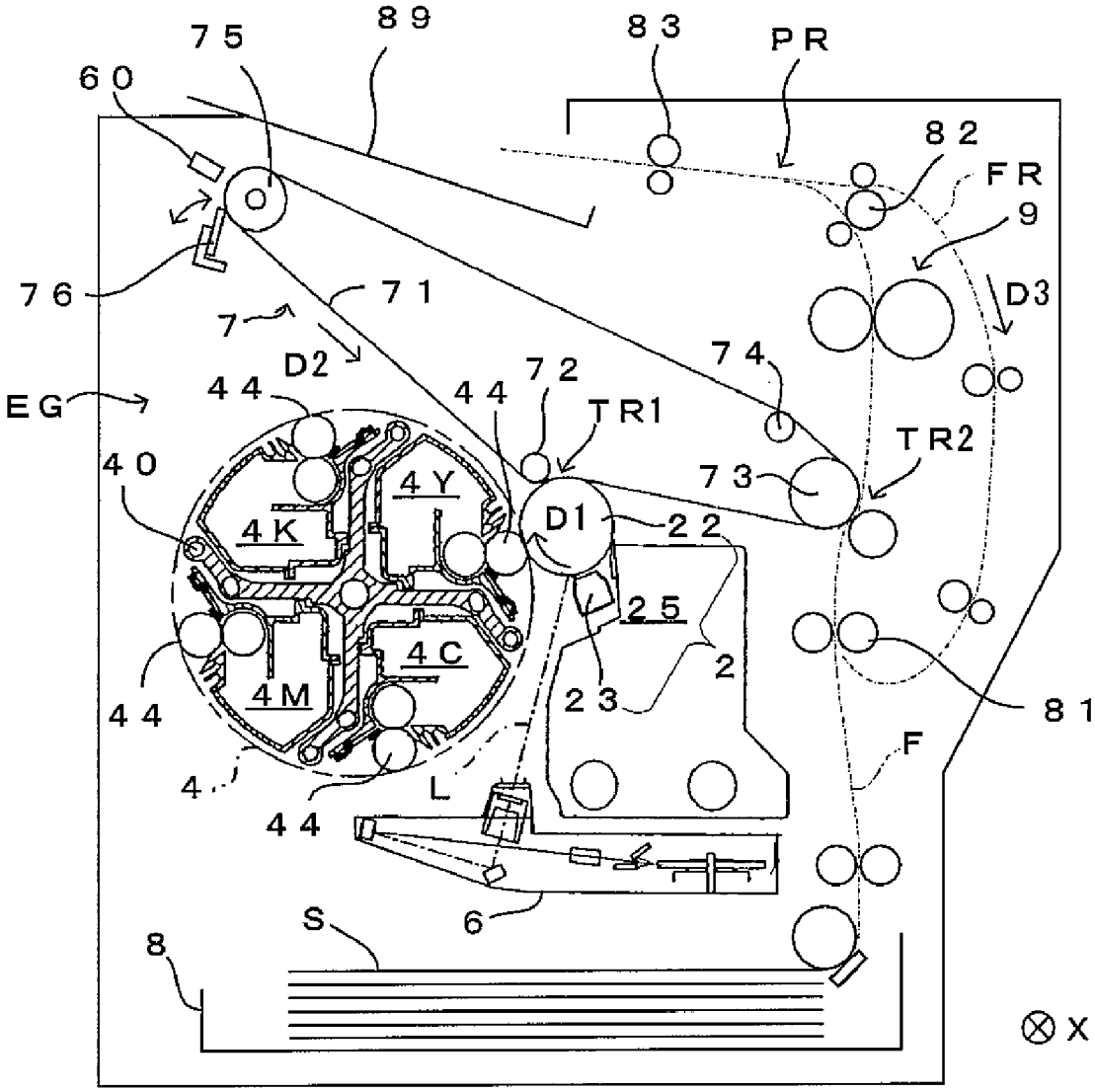
FIG. 1 is a diagram showing an embodiment of an image forming apparatus according to the invention.
Figure 2:
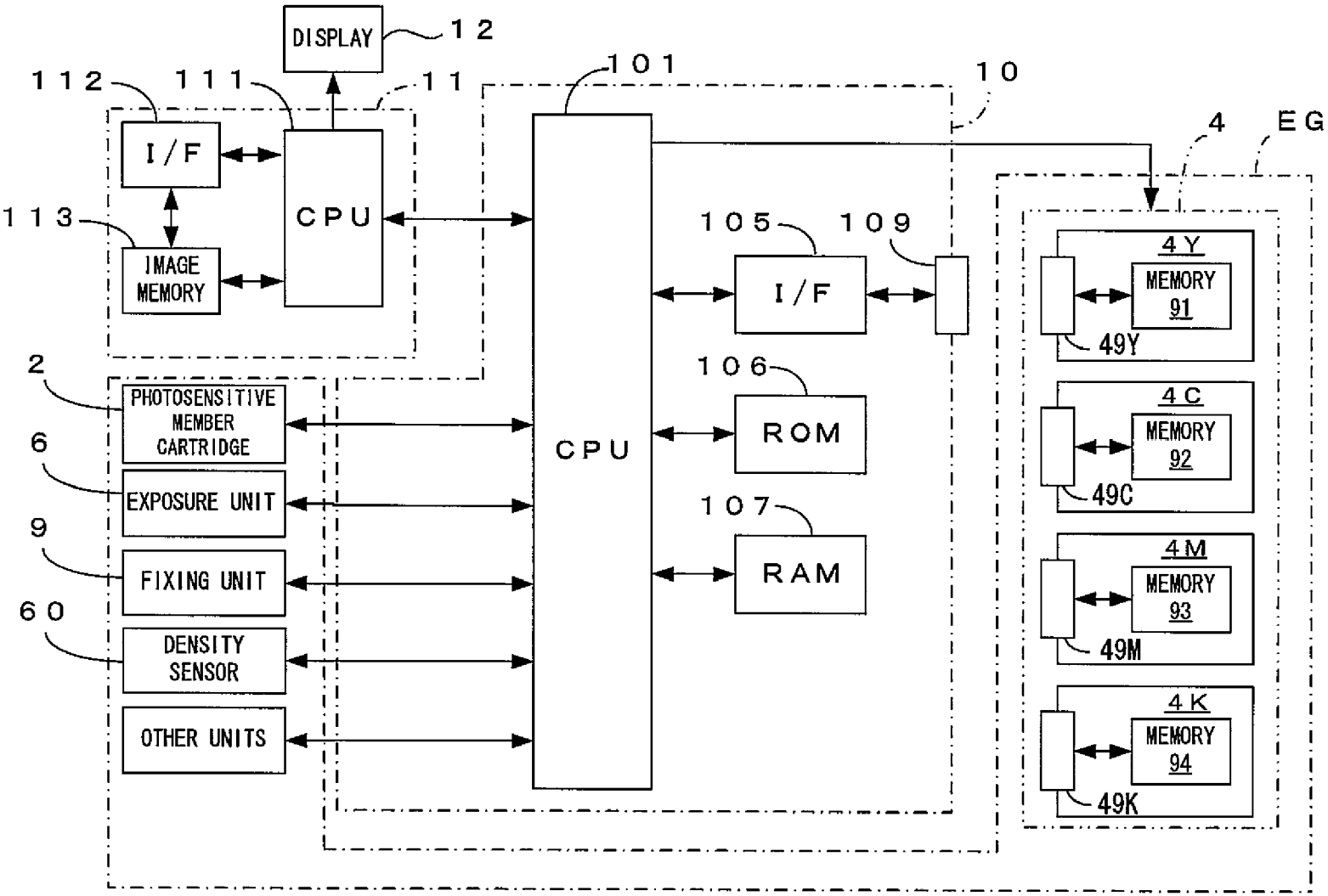
FIG. 2 is a block diagram of an electric structure of the image forming apparatus which is shown in FIG. 1.

FIG. 1 is a diagram showing an embodiment of an image forming apparatus according to the invention. FIG. 2 is a block diagram of an electric structure of the image forming apparatus which is shown in FIG. 1. This apparatus is an image forming apparatus which overlays toner (developing powder) in four colors of yellow (Y), cyan (C), magenta (M) and black (K) one atop the other and accordingly forms a full-color image, or forms a monochromatic image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 as cartridges and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. In this way, the electrostatic latent image on the photosensitive member 22 is visualized with the toner of the selected color.

Figure 3:
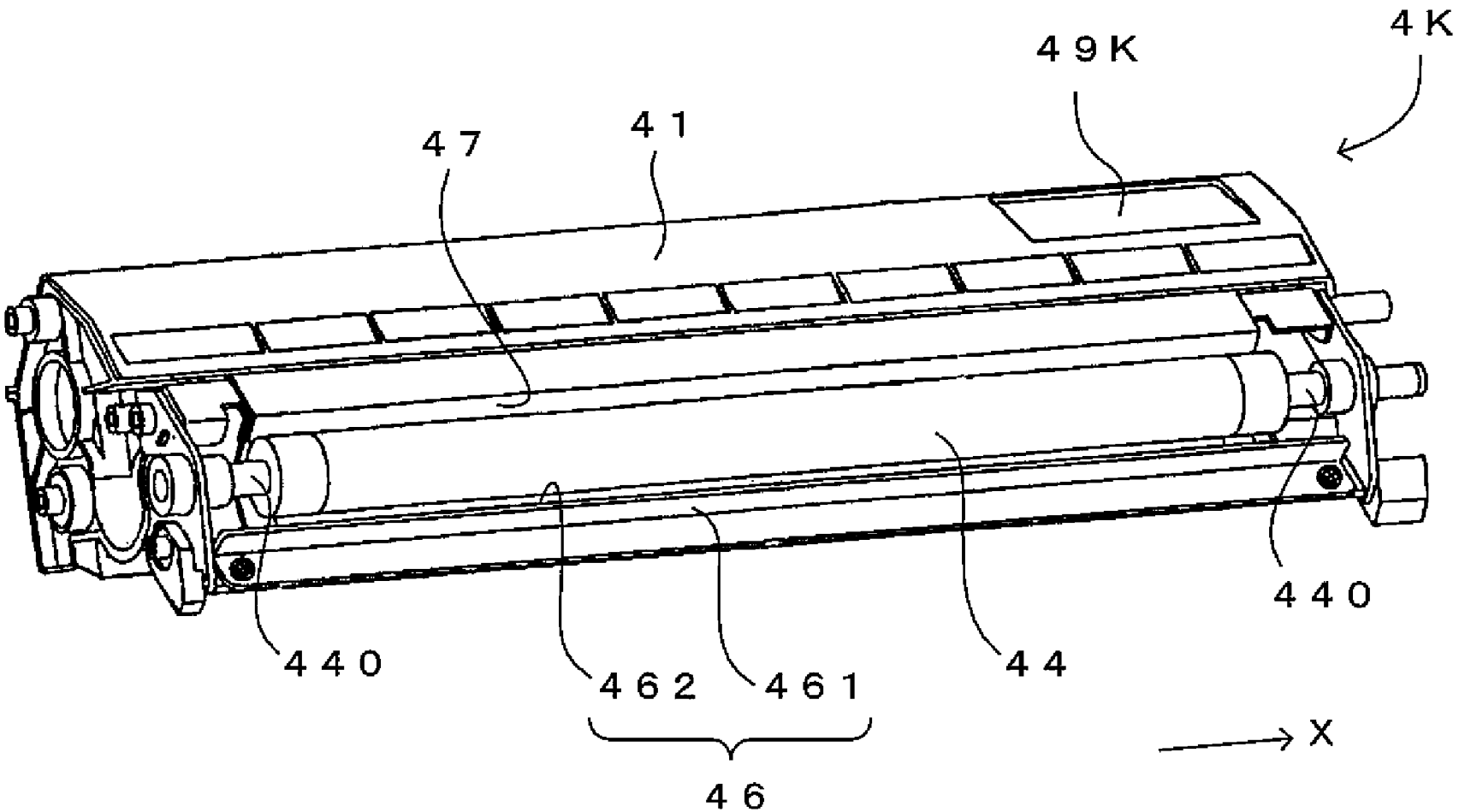
FIG. 3 is a diagram showing the appearance of the developer.
Figure 4A:
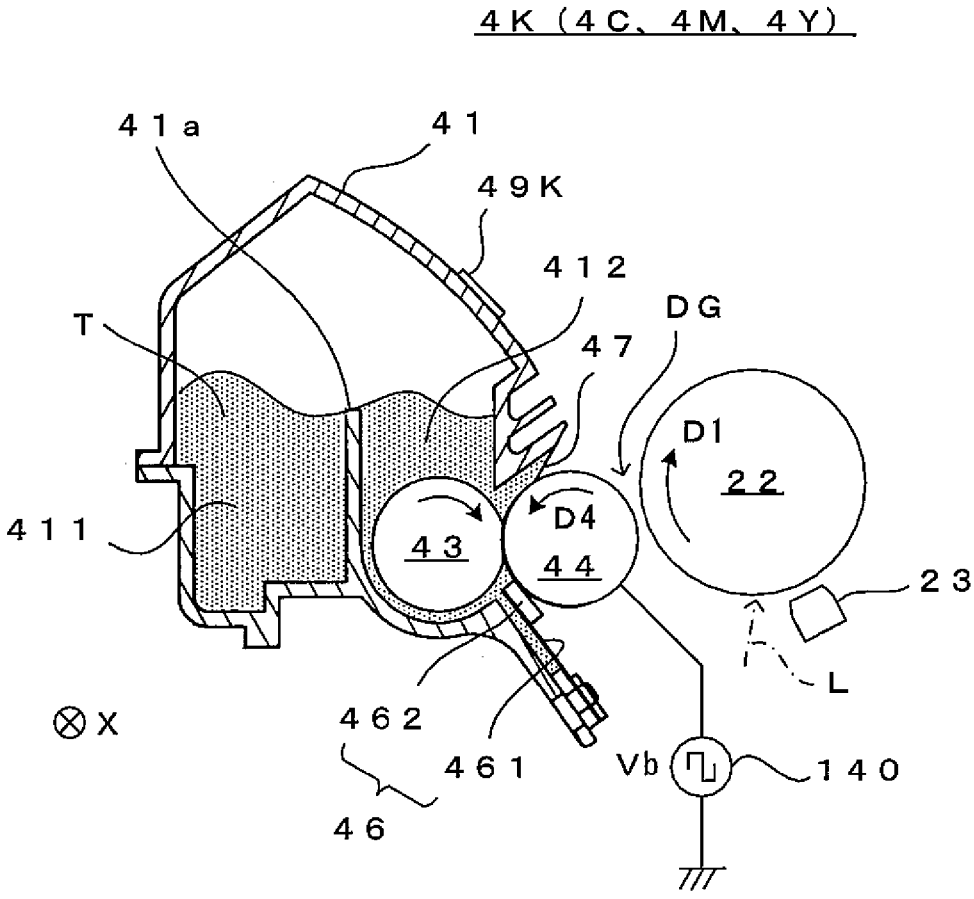
FIG. 4A is a cross sectional view showing a structure of the developer.
Figure 4B:
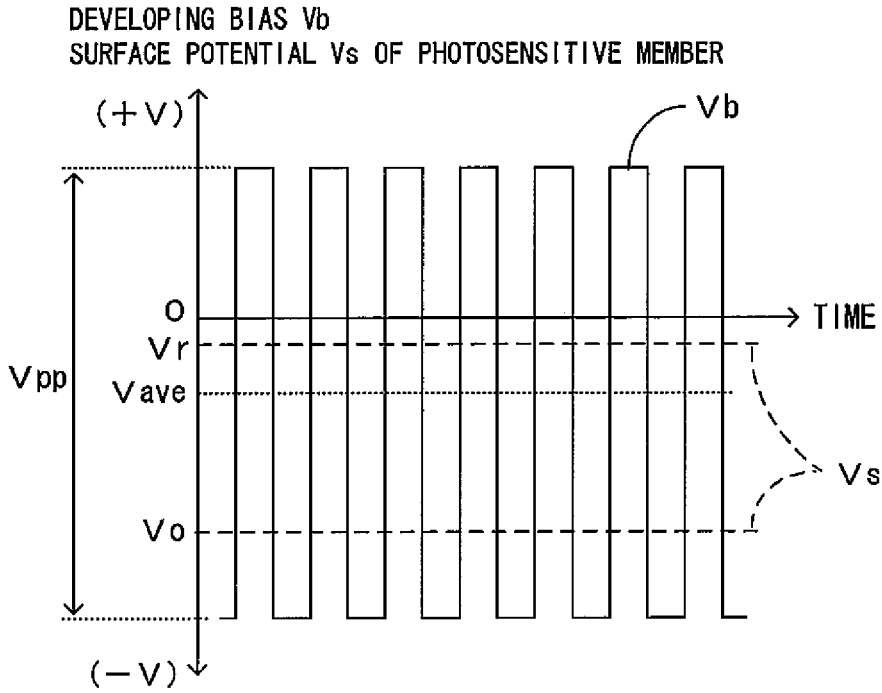
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y, 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed positions against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential Vo at non-exposed segments not exposed by the light beam L. Meanwhile, the developing bias Vb applied to the developing roller 44 is a rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby all electrostatic latent image on the photosensitive member 22 is visualized as a toner image in the color of the toner.

A rectangular-wave voltage having a peak-to-peak voltage Vpp of 1500V and a frequency of about 3 kHz, for example, may be used as the developing bias voltage Vb. Since an electric potential difference between the direct current component Vave of the developing bias voltage Vb and a residual potential Vr of the photosensitive member 22 constitutes a so-called development contrast which affects image density, the direct current component Vave may be set to a required value for obtaining a predetermined image density.

The housing 41 further includes a seal member 47 which is pressed against the surface of the developing roller 44 on the downstream side to the opposed position facing the photosensitive member 22 in the rotation direction of the developing roller 44. The seal member 47 is a belt-like film made of a flexible fluororesin material such as PTFE (polytetrafluoroethylene) extending in a direction X parallel to a rotational axis of the developing roller 44. One end of the seal member 47 in a direction perpendicular to the direction X is fixed to the housing 41, and the other end of the seal member 47 abuts on the surface of the developing roller 44. The other end of the seal member 47 is allowed to abut on the developing roller 44 as directed toward the downstream side in the rotation direction D4 of the developing roller 44, or directed in a so-called trail direction. The other end of the seal member 47 guides toner which remains on the surface of the developing roller 44 after moving past the opposed position facing the photosensitive member 22 to inside the housing 41 and prevents toner inside the housing from leaking to outside. The more detailed instruction about the seal member 47 is will be described later.

Figure 5:
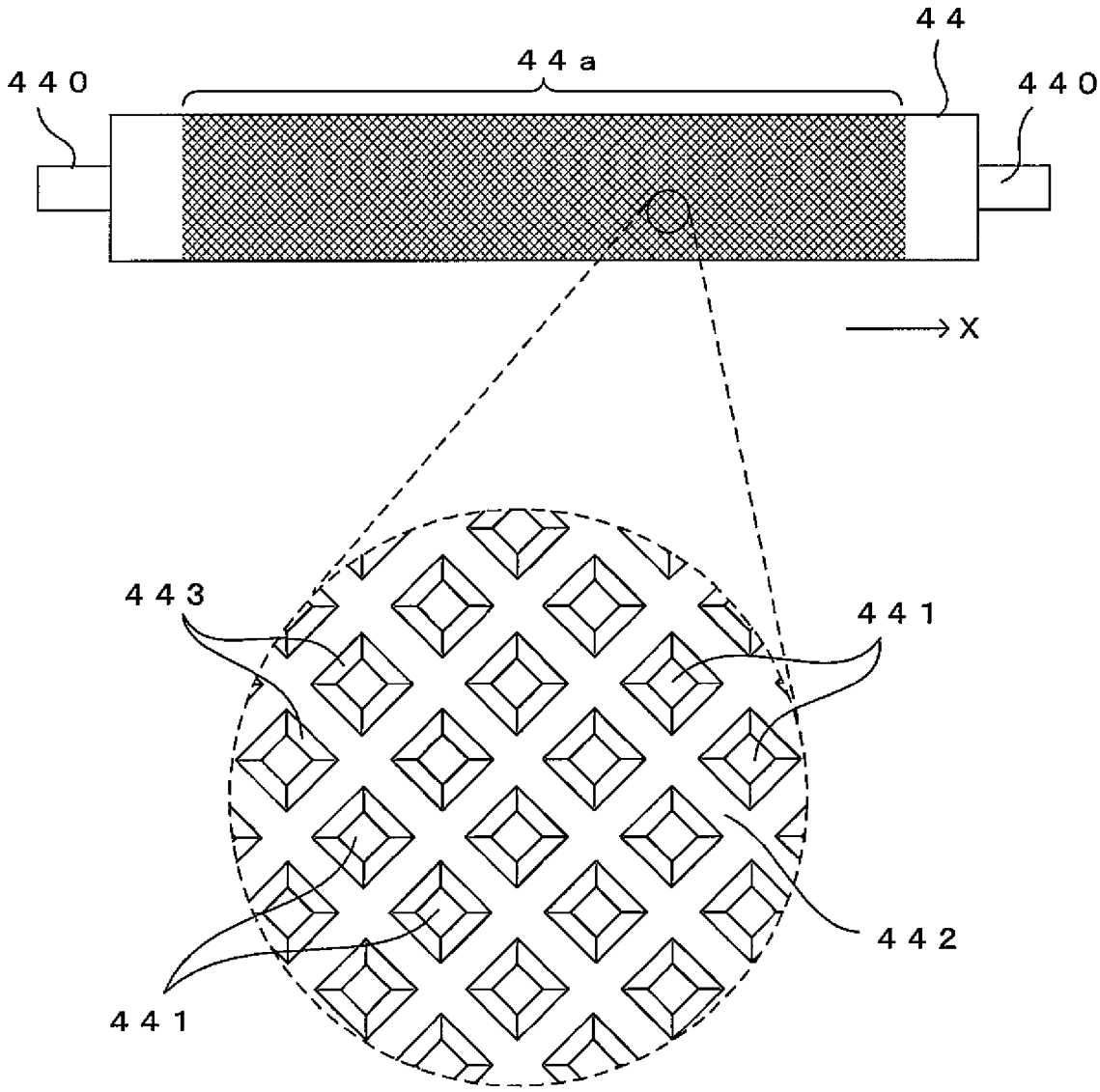
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with a rotational axis of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotational axis of the developing roller 44. Moderate slants 443 connect the convex sections 441 to the concave section 442 which surrounds the convex sections 441. That is, a normal line to the slants 443 contains a component which is outward in the radius direction of the developing roller 44 (upward in FIG. 5), that is, which is in a direction away from the rotational axis of the developing roller 44. The developing roller 44 having such a structure may be made by the manufacturing method described in JP-A-2007-140080 for instance.

Figure 6A:
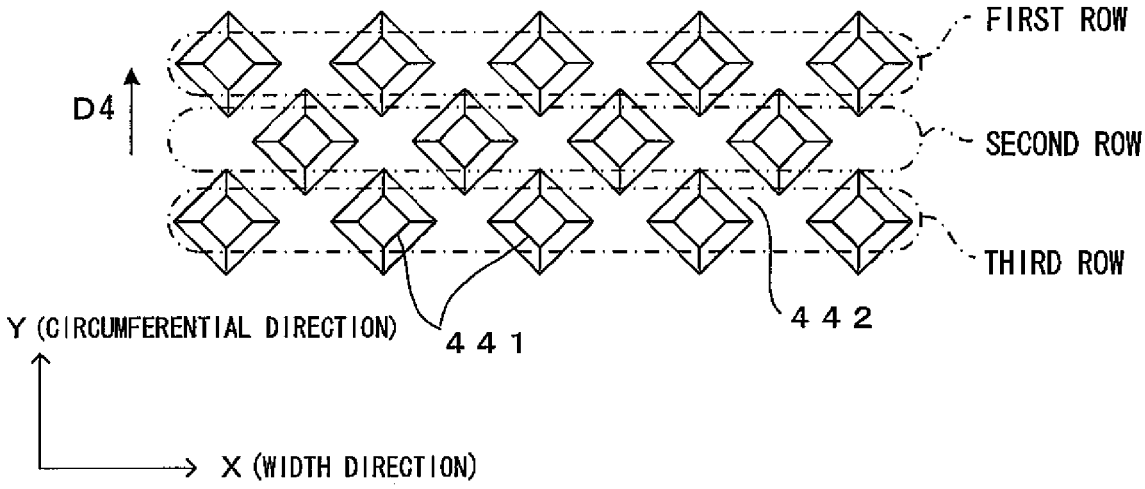
FIGS. 6A and 6B are plan development views showing the structure of the surface of the developing roller in further detail.
Figure 6B:
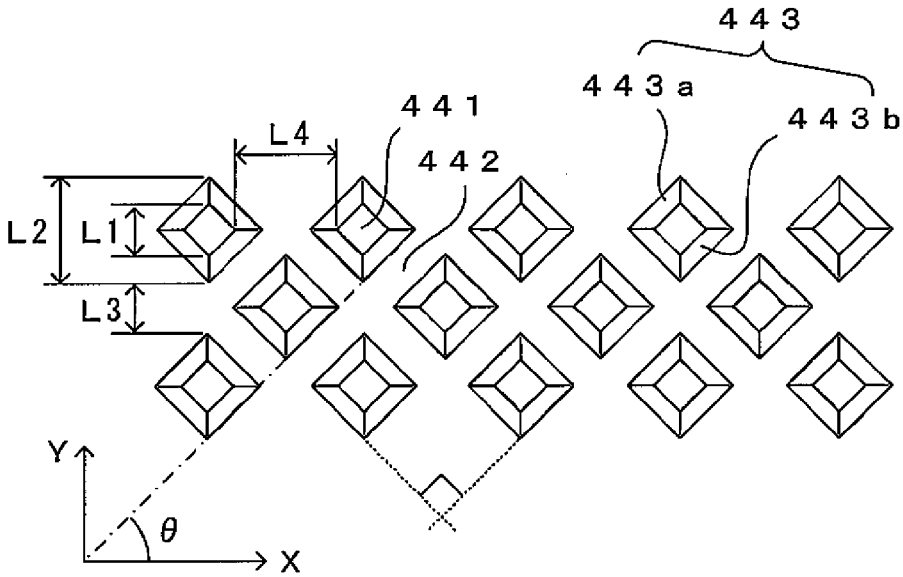

FIGS. 6A and 6B are plan development views showing the structure of the surface of the developing roller in further detail. Each one of the convex sections 441 in the surface of the developing roller 44 has a top section which is shaped like an approximately square projection rotated 45 degrees as shown in FIG. 6A. A number of such convex sections 441 are arranged linearly at equal intervals in the width direction X which is parallel to the rotational axis of the developing roller 44, thereby constituting convex section row. A plurality of convex section rows are provided also in a circumferential direction Y, which is orthogonal to the width direction X, at different positions on the circumferential surface of the developing roller 44. FIG. 6A shows three convex section rows, which will be hereinafter referred to as "the first row", "the second row" and "the third row" from the top in FIG. 6A.

As shown in FIG. 6A, the positions of the convex sections 441 along the width direction X are displaced half the arrangement pitch of the convex sections 441 from each other between the first and the second rows. This holds true as for the positions between the second and the third rows as well. That is, the convex section rows are arranged such that the convex sections 441 are in a staggered pattern in the surface of the developing roller 44. Therefore, it can be said that rows of the convex sections which are arranged in an oblique direction which is at a degree of θ (=45 degree) with respect to the width direction X on the surface of the developing roller 44.

Dimensions of the respective sections are described with reference to FIG. 6B. A length L1 of a diagonal of the top surface of the convex section 441 is 50 μm in both in X and Y directions, and a length L2 of a diagonal of the bottom part of the convex section 441 is 100 μm both in the X and Y directions. An interval L3 between the bottom parts of two convex sections located at the same position in the X direction and adjacent to each other in the Y direction is 50 μm, and an interval between the bottom parts of the two convex sections located at the same position in the Y direction and adjacent to each other in the X direction is same. From these relationships, an interval L4 of two convex sections located at the same position in one direction (X direction or Y direction) and adjacent to each other in the other direction is 100 μm. The dimensions of the respective sections are not limited to these numerical values and may be appropriately changed.

Out of the slants 443 connecting the convex sections 441 and the concave sections 442, the slants 443*a* located before the convex sections 441 in the moving direction D4 of the surface according to the rotation of the developing roller 44 and the slants 443*b* located behind the convex sections 411 have different inclinations. The reason for this is described in detail later.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this image forming apparatus, non-contact data transmission using electro-magnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as the developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this image forming apparatus, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer. That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other. However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure described above meets the demand. Small-particle toner generally has a high saturation charge level but gets charged slowly at the beginning, and hence, toner carried by the convex sections 441 tends to have a significantly higher charge level (get excessively charged) than toner carried by the concave sections 442. A charge level difference thus created shows itself as a development history in an image. Further, with respect to toner having a low melting point, fixing of toner to each other and fixing of the toner to the developing roller 44 and the like could easily occur by the friction contact of toner with each other or with the developing roller 44. However, such a problem is less likely to occur where the structure described above is used in which only the concave section 442 carries toner.

Next, the problem of the electrical charging of the seal member 47 as a subject matter of the invention is studied. The seal member 47 receives electric charges from the toner by touching the charged toner remaining on and adhering to the surface of the developing roller 44. In this way, the toner is discharged and becomes more easily separable from the surface of the developing roller 44 to be collected into the housing 41. The collected toner has the electrification charges reset and is mixed with the toner stored in the housing 41.

In order to increase the action of discharging the toner, the seal member 47 preferably has a function of charging the toner with a polarity opposite to the charging polarity of the toner. Accordingly, at least a surface area of the seal member 47 which possibly comes into contact with the developing roller 44 is preferably made of a material located at a position to charge the toner with the polarity opposite to the charging polarity in triboelectric series. For example, widely used acrylic or styrene-acrylic toner is negatively chargeable toner, and fluororesin such as PTFE (polytetrafluoroethylene), vinyl chloride or PE (polyethylene) located at a more negative side (lower side) than the material of the toner in triboelectric series can be cited as a material for changing the charged potential of the toner toward a positive side.

On the other hand, the seal member 47 is charged with the same polarity with the charging polarity of the toner by the received electric charges. Particularly, any one of the materials cited above for itself has high electrical insulation and thus is easily charged by the accumulation of the electric charges received from the toner. If the seal member 47 is charged with the same polarity as the toner, it produces a repulsive force to the approaching charged toner. Since an ability to receive further electric charges decreases, the function of discharging the charged toner decreases. Further, the negatively charged seal member 47 adsorbs positively charged or electrically neutral toner particles, external additive particles and the like, which may be fixed to the seal member 47 and the surface of the developing roller 44 to cause filming. Any of these becomes a cause of toner scattering from the developing roller 44 in the vicinity of the seal member 47, fogging and image defects such as image streaks.

In order to solve this problem, the image forming apparatus of this embodiment employs the following constructions:

(1) The surface of the developing roller 44 is provided with a multitude of convex sections 441 forming parts of the same cylindrical surface.

(2) The developing roller 44 is made of a metal to provide the top surfaces of the respective convex sections 441 with electrical conductivity and to electrically connect the respective convex sections with each other.

(3) The seal member 47 is made of a material in which carbon particles are dispersed in a resin base material having an action of discharging the toner to provide electrical conductivity.

(4) A PTFE resin having a particle diameter of 20 to 30 μm is used as the resin base material.

Next, reasons for employing the above constructions are separately described with reference to FIGS. 7A to 10B. First of all, the above constructions (1) and (2) are described.

Figure 7A:
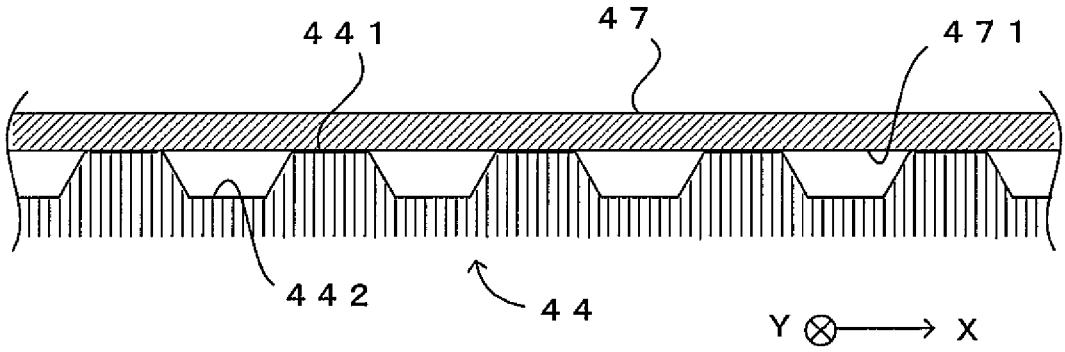
FIGS. 7A and 7B are diagrams showing contact states of the developing roller and the seal member.
Figure 7B:
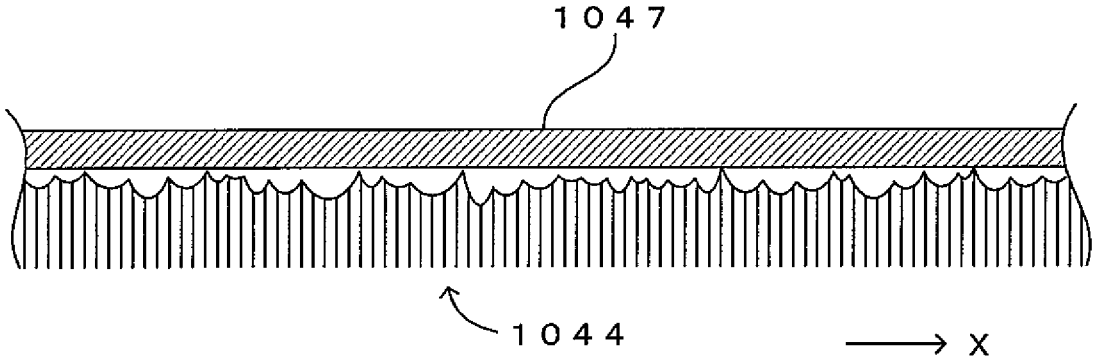

FIGS. 7A and 7B are diagrams showing contact states of the developing roller and the seal member As described above (see FIGS. 5 and 6A), a multitude of convex sections 441 are provided on the surface of the developing roller 44 in this embodiment. The respective top surfaces of the convex sections 441 form the same cylindrical surface. Thus, as shown in FIG. 7A, a contact surface 471 of the seal member 47 in contact with the developing roller 44 and the top surfaces of the respective convex sections 441 on the surface of the developing roller 44 are in surface contact and contact pressures are substantially uniform at positions where the contact surface 471 of the seal member 47 and a plurality of convex sections 441 face each other. As a result, at the respective positions, the seal member 47 and the convex sections 441 can be reliably held in contact. Although parts of the contact surface 471 of the seal member 47 facing the concave sections 442 look not to be in contact with the surface of the developing roller 44, the convex sections belonging to other rows actually come into contact with these parts by a movement of the developing roller 44 in the Y direction of FIG. 7A.

Since the developing roller 44 is metallic, the top surfaces of the respective convex sections 441 have electrical conductivity and the respective convex sections 441 are electrically connected to each other. Thus, electric charges accumulated in the respective parts of the seal member 47 can be reliably transferred toward the developing roller 44 by the contact with the convex sections 441. Further, since the developing roller 44 is connected with the bias power source 140, the electric charges from the seal member 47 are allowed to escape to the outside via the bias power source 140.

A conventional structure obtained by finishing a developing roller surface by a sandblast process is shown as a comparative example in FIG. 7B. As shown in FIG. 7B, a multitude of round recesses are present in a surface of a developing roller 1044 finished with the blast process, and the depths of the recesses and the heights of projecting parts are not uniform and vary. Thus, if a seal member 1047 is brought into contact with this surface, areas of the developing roller surface actually in contact with the seal member 1047 are only parts largely projecting as compared with the surrounding and a state of this contact is substantially point contact. It can be hardly expected to smoothly transfer electric charges from the seal member 1047 to the developing roller 1044 via such unreliable contact parts.

As described above, in this embodiment, the multitude of convex sections 441 having electrical conductivity and forming parts of the same cylindrical surface are provided on the surface of the developing roller 44 and are brought into contact with the seal member 47. In this way, electric charges accumulated on the seal member 47 are allowed to stably and reliably escape to the developing roller 44, thereby preventing the electrical charging of the seal member 47. Since a conduction path for the discharged electric charges is short, the electric charges can be efficiently discharged even by a short-lasting contact. The potential of the seal member 47 is the same as that of the developing roller 44. By doing so, a useless transfer of electric charges between the developing roller 44 and the seal member 47 can be eliminated. The seal member 47 may be connected with the bias power source 140 to apply the same development bias potential as the one applied to the developing roller 44. However, since the seal member 47 has electrical conductivity and is electrically connected with the surface of the developing roller 44 in this embodiment, potential may not be actively given.

Next, the above constructions (3) and (4) are described. As described above, the seal member 47 is preferably made of the material having the action of discharging the toner. Since the negatively chargeable toner is used in this embodiment, PTFE is used as a material having an action of positively charging this toner. Further, in order to allow the accumulated electric charges to smoothly escape, carbon particles are dispersed in a PTFE base material in the used material. The PTFE base material used is such that a particle diameter of crystals constituting the base material is about 20 to 30 μm. The reason for this is as follows.

Figure 8A:
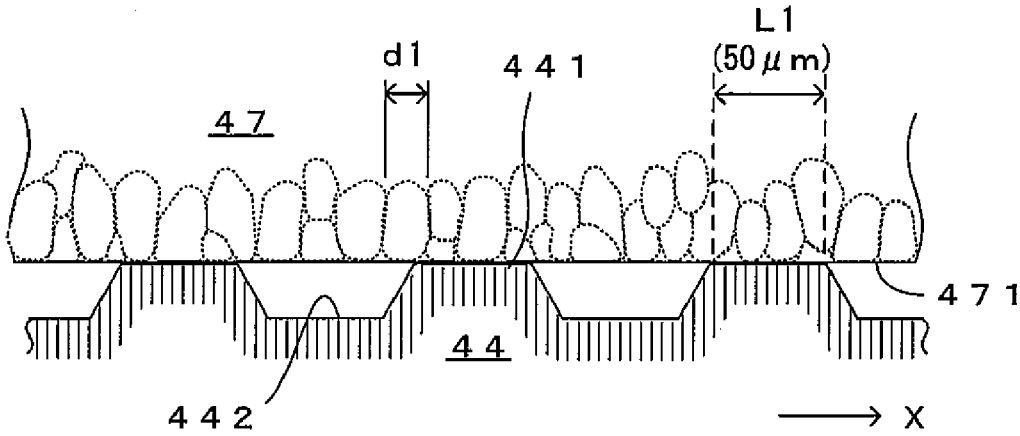
FIGS. 8A and 8B are diagrams showing grain structures of seal members.
Figure 8B:
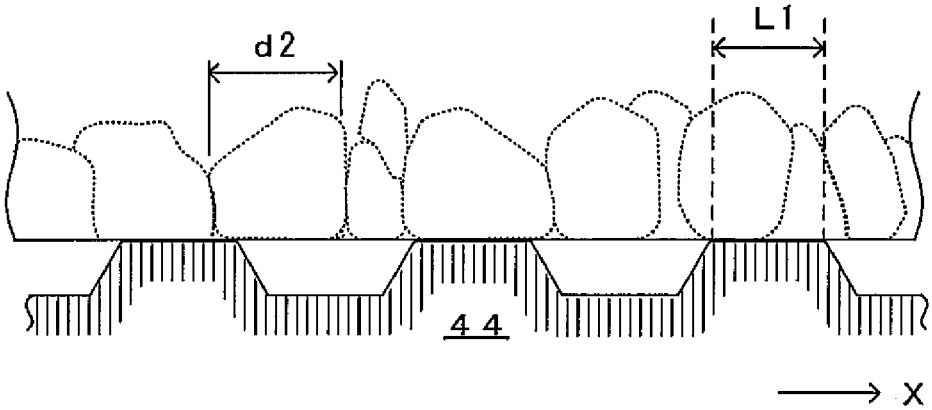

FIGS. 8A and 8B are diagrams showing grain structures of seal members. A resin material such as PTFE is microscopically an aggregate of many crystals. Additive particles such as carbon particles dispersed in the resin base material are not uniformly distributed in the entire base material but mostly penetrate into grain boundaries. Specifically, the electric charges accumulated on the seal member 47 transfer toward the developing roller 44 not inside the crystals, but via electrically conductive particles such as carbon particles distributed along the grain boundaries. In other words, conduction paths in the case of allowing the electric charges to escape from the seal member 47 are formed along the grain boundaries. From this perspective, a case where crystal grains are small as shown in FIG. 8A (representative particle diameter: d1) and a case where crystal grains are large as shown in FIG. 8B (representative particle diameter: d2>d1) are compared and studied. In FIGS. 8A and 8B, dotted line indicates the grain boundaries of the resin base material.

In this embodiment, the maximum length of the top surface of the convex section 441 is about 50 μm. This corresponds to the length L1 of the diagonal of the rhombic shape of the top surface of the convex section 441, for example, shown in FIG. 6B. As shown in FIG. 8A, a plurality of grains making up the seal member 47 come into contact with the top surfaces of the convex sections 441 if the particle diameter d1 of the resin base material forming the seal member 47 is sufficiently smaller than the length L1. Thus, the grain boundaries of these crystals appear at the contact parts with the convex sections 441. As a result, the conduction paths by way of the electrically conductive particles distributed in the grain boundaries and the top surfaces of the convex sections 441 are formed, and the electric charges accumulated on the seal member 47 are efficiently discharged toward the developing roller 44.

On the other hand, if the particle diameter d2 of the resin base material forming the seal member 47 is larger than the maximum length L1 of the top surfaces of the convex sections 441 as shown in FIG. 8B, there are cases where the contact part with the convex section 441 is taken up by a single crystal grain to weaken the action of discharging the electric charges via the crystal grains.

Accordingly, the resin base material having an average particle diameter (20 to 30 μm) smaller than the maximum length L1 (50 μm) of the top surfaces of the convex sections 441 is used in this embodiment. By doing so, the electric charges accumulated on the seal member 47 can be efficiently discharged via the grain boundaries.

FIG. 9 is a table showing constitutions and evaluation results of seal members. The inventors of this application prepared a plurality of samples of the seal member from different materials and various evaluations were conducted by mounting these in the apparatus. PTFE and PE resins as representative materials for positively charging (or reducing the charged amount of) the negatively charged toner were used as the resin base material to prepare a plurality of samples of the seal member having different particle diameters. As evaluation items, a degree of fogging on a formed image, a toner scatter amount from the surface of the developing roller 44 and a degree of streaky defect (image streak) produced in the image were used. The lower these degrees and amount were, the higher the evaluations were.

As a result, as shown in FIG. 9, the best result was obtained in the respective evaluation items of fogging, toner scattering and image streaks when the PTFE base material, in which carbon particles were dispersed and whose average particle diameter was 25 μm was used. In other words, the levels of fogging, toner scattering and image streaks were all lowest. Further, the second best result was obtained when the PTFE base material, in which carbon particles were dispersed and whose average particle diameter was 50 μm was used. On the other hand, no good result was obtained when the particle diameter was 100 μm even if the PTFE base material, in which the same carbon particles were dispersed, was used. As described above, the average particle diameter of the base material is preferably equal to or smaller than the maximum length of the convex sections 441 in the X direction.

If the base material is a PE resin, the result was rather poor when the particle diameter was 80 μm and poor when the particle diameter was 150 μm. In the case of PE resins, those generally distributed in the market are only those having relatively large particle diameters. If the maximum length of the convex sections 441 is about 50 μm as in this embodiment, fluororesins such as PTFE having smaller particle diameters can be said to be most suitable as the base material of the seal member. Accordingly, in this embodiment, a material, in which carbon particles are dispersed in a PTFE resin base material having an average particle diameter of 20 to 30 μm was used as the material of the seal member 47.

The fluororesin having such fine grains may be ground by being abraded against the convex sections 441 on the surface of the developing roller 44 and adhere to the surfaces of the convex sections 441. However, since the resin adhering to the top surfaces of the convex sections 441 in this way has an effect of suppressing new toner adhesion, it also has an effect of preventing filming on the developing roller 44.

In this embodiment, the developing roller 44 has the following surface structure to make the action of discharging the seal member 47 more effective.

Figure 10A:
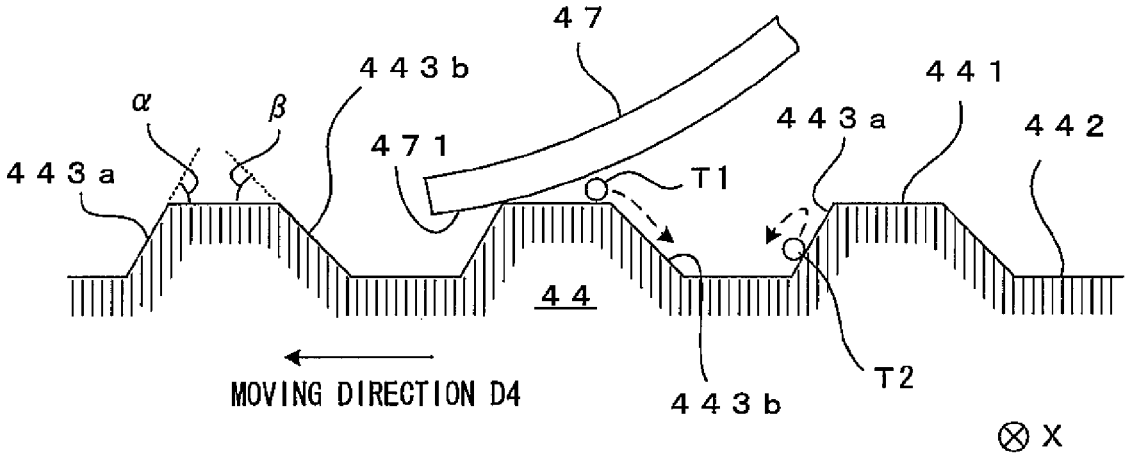
FIGS. 10A and 10B are diagrams showing a cross section structure of the developing roller surface when viewed in the axial direction.
Figure 10B:
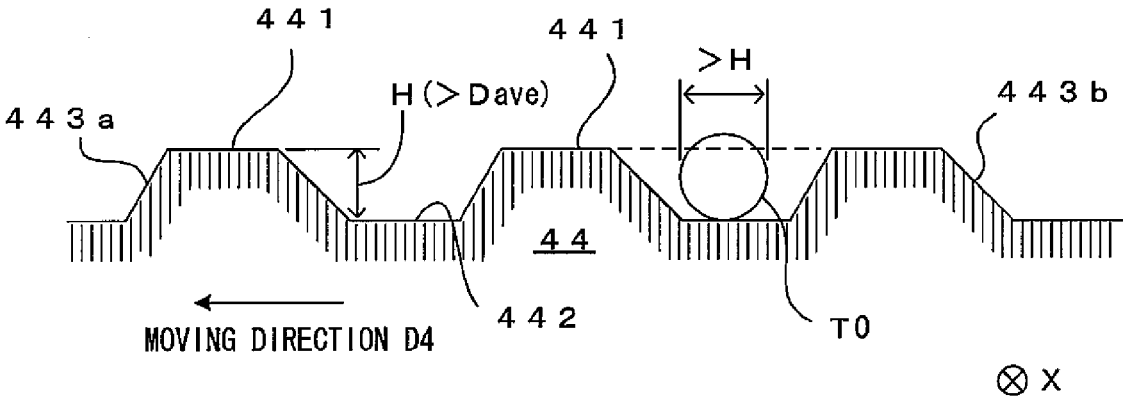

FIGS. 10A and 10B are diagrams showing a cross section structure of the developing roller surface when viewed in the axial direction. As shown in FIG. 10A, out of the slants 443 connecting the convex sections 441 and the concave sections 442, the inclination of the slants 443*a* located before the convex sections 441 in the moving direction D4 according to the rotation of the developing roller 44 is set larger than that of the slants 443*b* located behind the convex sections 441 in the same direction in this embodiment. In other words, a relationship of $\alpha>\beta$ holds between angles $\alpha$, $\beta$ shown in FIG. 10A.

This is for preventing toner T2 adhering to the concave sections 442 or the slants 443*a*, 443*b* from climbing up the slants 443*a* to come onto the convex sections 441 while smoothly conveying toner T1 adhering to the top surfaces of the convex sections 441 to the concave sections 442 along the slants 443*b* by the contact with the seal member 47 or by a repulsive force thereof. If the toner adheres to the top surfaces of the convex sections 441, this toner is squeezed between the seal member 47 and the convex sections 441 to be abraded, whereby this toner is fixed to one surface or the external additive is caused to be separated, thereby deteriorating the property. In this embodiment, the occurrence of such problems is prevented by making the transfer of the toner T2 adhering to the concave sections 442 or the slopes 443 to the convex sections 441 difficult while making the transfer of the toner T1 adhering to the convex sections 441 to the concave sections 442 smoother.

Further, as shown in FIG. 10B, an elevation difference H between the convex sections 441 and the concave sections 442 is set equal to or larger than a volume average particle diameter Dave of the toner. If toner T0 having a particle diameter larger than the elevation difference H between the convex sections 441 and the concave sections 442 is carried in the concave sections 442, the top thereof projects from the top surfaces of the convex sections 441. In this case, the toner T0 lifts the seal member 47 up to cancel the electrical connection with the convex sections 441. If such a situation occurs with a high probability, the seal member 47 and the developing roller 44 are held in direct contact for a shorter time, whereby electric charges accumulated on the seal member 47 cannot efficiently escape. If the elevation difference H between the convex sections 441 and the concave sections 442 is set equal to or larger than the volume average particle diameter Dave of the toner, an occurrence probability of such a situation can be made quite small. For example, in an apparatus using toner having a volume average particle diameter of 5 μm, the elevation height H may be set to about 6 μm.

Next, an operation of more reliably preventing the electrical charging of the seal member 47 is described. As described above, it is preferable to carry no toner on the convex sections 441 in this embodiment. To this end, the restriction blade 46 acts to carry the toner only in the concave sections 442 on the developing roller surface. This is preferable in preventing the toner adhesion to the seal member 47 and the electrical charging of the seal member 47. In other words, by bringing the convex sections 441 into contact with the seal member 47 without toner adhesion, the electrical connection between the seal member 47 and the developing roller 44 is ensured so that electric charges accumulated on the seal member 47 are allowed to reliably escape to the developing roller 44. However, the adhesion of the toner jumped from the developing roller 44 to the convex sections 441 is actually thought to be unavoidable if an image forming operation is performed and a development bias is applied to the developing roller 44.

Accordingly, in addition to the discharging action during the image forming operation, a seal discharging operation of actively discharging the seal member 47 by rotating the developing roller 44 to bring it into contact with the seal member 47 with no toner carried on the convex sections 441 may be performed at a specified timing. The operation of the image forming apparatus including the seal discharging operation may be set, for example, as follows.

Figure 11:
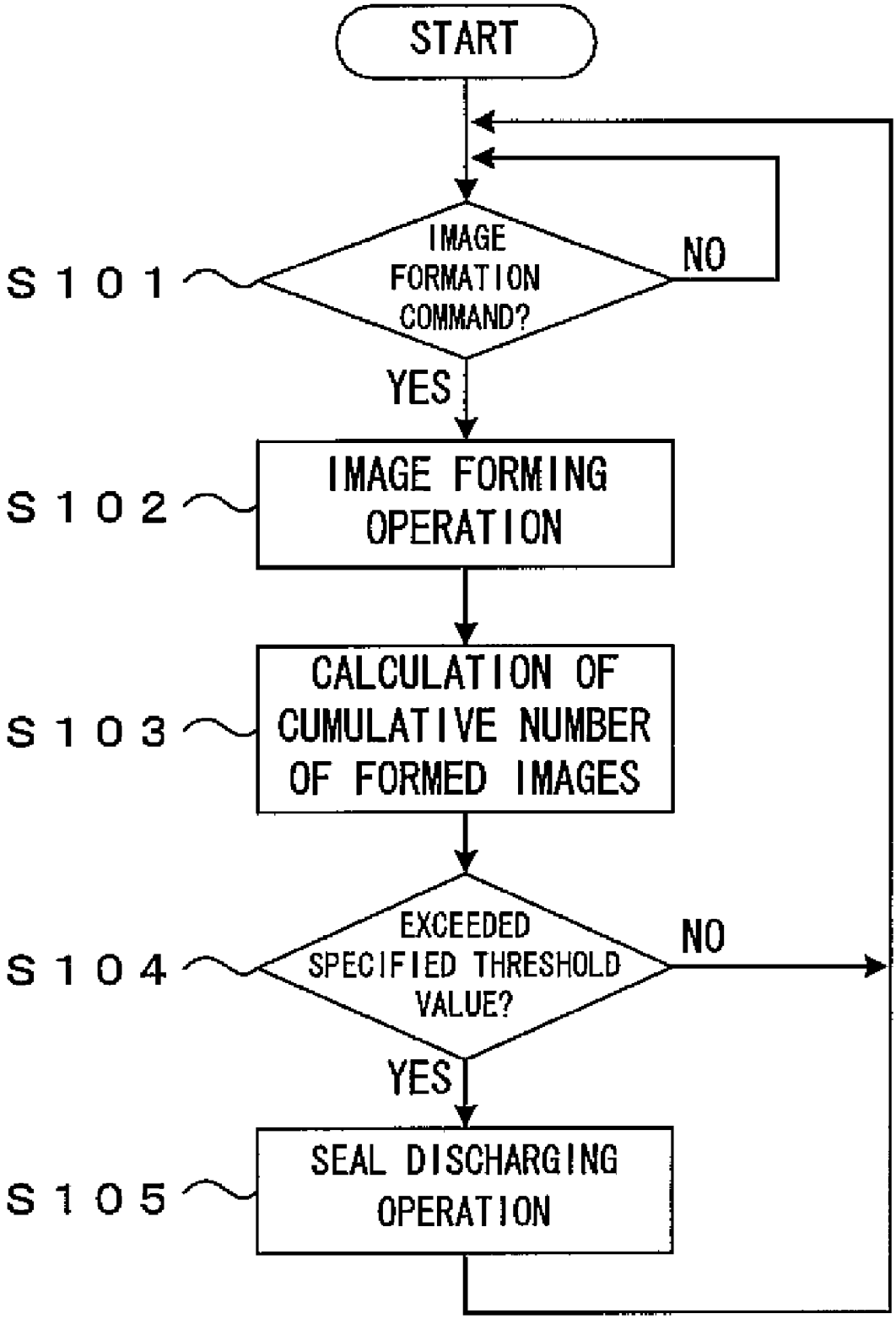
FIG. 11 is a flow chart showing the operation of the image forming apparatus including the seal discharging operation.

FIG. 11 is a flow chart showing the operation of the image forming apparatus including the seal discharging operation. The apparatus waits on standby until an image formation command is given from the outside (Step S101). Upon receiving the image formation command, an image forming operation is performed to form an image corresponding to the command (Step S102). Then, a cumulative image number as a cumulative number of images formed using this developer is calculated (Step S103).

Whether or not the cumulative image number has exceeded a specified threshold value is judged (Step S104). Here, threshold values can be set, for example, in 100s, 500s or 1000s. Unless the cumulative image number has reached the threshold value, this flow returns to Step S101 to wait for a new image formation command. On the other hand, if the cumulative image number has exceeded the threshold value, the seal discharging operation is performed (Step S105).

For example, the following operation may be performed as the seal discharging operation. Specifically, the developing roller 44 is rotated for a specified time without applying any development bias thereto, more preferably while being grounded. By doing so, the surface of the developing roller 44 having toner adhesion to the convex sections 441 restricted by the restriction blade 46 directly reaches the contact position with the seal member 47. As a result, the convex sections 441 carrying no toner directly come into contact with the seal member 47, whereby electric charges accumulated on the seal member 47 are discharged. After the seal member 47 is discharged in this way, this flow returns to Step S101 to wait for the input of a new image formation command.

By doing so, the occurrence of toner adhesion to the seal member 47 and the developing roller 44, fogging, toner scattering and the like can be more reliably prevented by more reliably removing electric charges accumulated on the seal member 47. Whether or not the toner is carried in the concave sections 442 in the seal discharging operation is optional. Even if the toner is carried in the concave sections 442, it can be prevented that a part of the jumped toner moves onto the convex sections 441 by stopping the application of the development bias to the developing roller 44 as described above, whereby the convex sections 441 can be brought into contact with the seal member 47 with no toner carried on the convex sections 441.

As described above, in this embodiment, a multitude of convex sections 441 whose top surfaces form parts of the same cylindrical surface are provided on the surface of the developing roller 44 and the seal member 47 made of the material having electrical conductivity by dispersing carbon particles in the PTFE resin base material having the action of discharging the toner is brought into contact with the surface of the developing roller 44. According to such a construction, electrification charges of the seal member 47 produced by the contact with the charged toner are allowed to more reliably escape toward the developing roller 44 by the surface contact with the convex sections 441, wherefore the occurrence of problems such as toner scattering, fogging and filming resulting from the electrical charging of the seal member 47 can be prevented.

Using the material whose grain size is smaller than the maximum length of the convex sections 441 as the resin base material of the seal member 47, electric charges accumulated on the seal member 47 are allowed to more efficiently escape to the developing roller 44 by making the transfer of electric charges via the grain boundaries smoother.

The invention is not limited to the above embodiment, and various changes other than the above can be made without departing from the gist thereof. For example, though already mentioned above, the execution of the "seal discharging operation" in the above embodiment is optional and not essential. This is because it is difficult to think the electrical connection between the convex sections 441 and the seal member 47 is completely hindered with such a small amount of the toner adhering to the convex sections 441 in a normal image forming operation and the action of discharging the seal member 47 is not drastically reduced.

Although carbon particles are used as electrically conductive particles to be added to the PTFE resin as the base material of the seal member 47 in the above embodiment, it is also possible to use, for example, metal particulates as the electrically conductive particles. Further, any material other than the above PTFE resin can be used as the base material of the seal member 47 provided that it has a function of discharging toner and small grain sizes.

In the above embodiment, the invention is applied to the image forming apparatus employing a so-called rotary development method in which a plurality of developers are mounted in the rotating rotary developer unit. An application subject of the invention is not limited to this and the invention is also applicable, for example, to an image forming apparatus employing a so-called tandem development method in which a plurality of developers are arranged in a rotation direction of a transfer medium or to a monochromatic image forming apparatus including only one developer.

As described above, in the above embodiment, the developers 4Y, 4M, 4C and 4K respectively function as a "developing device" of the invention. In the above embodiment, the photosensitive member 22, the developing roller 44 and the seal member 47 respectively function as a "latent image carrier", a "toner carrier roller" and a "seal member" of the invention. Further, the housing 41 and the restriction blade 46 respectively function as a "housing" and a "restricting member" of the invention. Further, the carbon particles dispersed in the PTFE resin forming the seal member 47 function as "electrically conductive particles" of the invention.

In the developing device and the image forming apparatus according to the invention, the contact surface of the seal member preferably has electrical conductivity to more effectively prevent the electrical charging of the seal member. Even if the contact surface of the seal member has electrical conductivity, the electrical charging is unavoidable unless a discharge path is provided. However, in this structure, electric charges accumulated on the seal member are allowed to reliably escape to the toner carrier roller by the contact of the seal member having electrical conductivity with the top surfaces of the convex sections of the toner carrier roller.

For example, the contact surface of the seal member can be made of a material obtained by dispersing electrically conductive particles in a resin base material which is located at a position to charge the toner with a polarity opposite to its charging polarity in triboelectric series. By making the contact surface of the resin base material, toner leakage can be effectively prevented and the abrasion of the toner discharging roller can be suppressed. Further, by using the material for charging the toner with the polarity opposite to its charging polarity, the charged toner can be efficiently discharged. By dispersing the electrically conductive particles in the resin base material, it is possible to provide the contact surface with electrical conductivity and to efficiently discharge electric charges received from the toner to the toner carrier roller.

In this case, the grain size of the resin base material is more preferably equal to or smaller than the length of the respective convex sections in a direction parallel to the rotational axis of the toner carrier roller. Although electric charges accumulated on the seal member are discharged to the toner carrier roller via the electrical conductive particles, the electrically conductive particles dispersed in the resin base material are eccentrically located in large quantity in grain boundaries of the base material. In other words, electric charges accumulated on the seal member are mainly transferred along the grain boundaries and finally discharged to the toner carrier roller. Accordingly, in order to allow the accumulated electric charges to efficiently escape, the contact surface of the seal member held in contact with the top surfaces of the convex sections of the toner carrier roller preferably includes at least one grain boundary. To this end, the grain size of the resin base material is preferably equal to or smaller than the length of the respective convex sections.

Further, a fluororesin such as PTFE (polytetrafluoroethylene) can be, for example, suitably used as the resin base material. Such a fluororesin material can be suitably used for a seal member since the toner is difficult to adhere to the surface due to good slipperiness of the surface. In the case of using generally used negatively chargeable toner such as acrylic toner or styrene-acrylic toner, a good action of discharging the toner can be obtained since the fluororesin has a property of positively charging these. The fluororesin generally has high electrical insulation and is easily charged, but electric charges are allowed to effectively escape to the toner carrier roller to prevent the electrical charging by dispersing the electrically conductive particles.

An elevation difference between the convex sections and the concave section is preferably equal to or larger than a volume average particle diameter of the toner. If the elevation difference between the both sections is small, toner may lift the seal member up to make the contact with the convex sections unstable when the toner having particle diameters larger than this elevation difference are carried in the concave section. If the elevation difference between the convex sections and the concave section is set equal to or larger than the volume average particle diameter of the toner, most of toner particles have particle diameters equal to or smaller than the elevation difference between the convex sections and the concave section, wherefore such a problem is unlikely to occur.

On the toner carrier roller surface, the inclination of slants connecting the convex sections and the concave section may be larger at a front side than at a rear side in a moving direction of the surface according to the rotation of the toner carrier roller. According to such a construction, even if the toner adheres to the top surfaces of the convex sections, the toner is easily scraped off by the contact with the seal member, whereas it is difficult for the toner carried in the concave section to be carried onto the top surfaces of the convex sections by the seal member. In other words, by employing such a construction, the toner carried on the convex sections can be reduced, thereby preventing the toner from being pressed between the top surfaces of the convex sections and the seal member to adhere to either surface or a hindrance to the electrical connection between the top surfaces of the convex sections and the seal member.

A restricting member may be provided which restricts toner adhesion to the top surfaces of the convex sections by coming into contact with the toner carrier roller surface at a position upstream of a contact position of the toner carrier roller and the seal member in the rotation direction of the toner carrier roller. As described above, the contact surface of the seal member needs to directly come into contact with the electrically conductive top surfaces of the convex sections of the toner carrier roller in order to allow electric charges accumulated on the seal member to effectively escape. By providing the restricting member to restrict the toner adhesion to the top surfaces of the convex sections, the convex sections can be brought into contact with the seal member while being exposed. Further, by causing only the concave section to carry the toner, a toner conveyance amount can be controlled.

In the toner carrier roller, the top surfaces of the respective convex sections are more preferably electrically connected to each other. By doing so, it becomes possible to deprive the seal member of more electric charges by dispersing the electric charges the convex sections received from the seal member, wherefore the electrical charging of the seal member can be more effectively prevented. In order to realize such a construction, the convex sections and the concave section may be formed, for example, by forming a multitude of grooves in a metal tube surface.

In the image forming apparatus according to the invention, it is preferable to provide an operation mode in which the seal member abuts on the toner carrier roller while the toner carrier being rotated without the toner being carried at least on the convex sections of the toner carrier roller surface. By bringing the convex sections carrying no toner and the seal member into contact, electric charges accumulated on the seal member are allowed to more reliably escape to the toner carrier roller.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A developing device, comprising:

a housing that stores toner inside;

a toner carrier roller that is shaped approximately like a cylinder, is mounted to the housing rotatabiy about a rotational axis, rotates while carrying the toner on a surface thereof to convey the toner to outside of the housing, and is provided, on the surface thereof, with a plurality of convex sections which are regularly arranged and a concave section which surrounds the convex sections, the convex sections including top surfaces that coincide with a part of a curved surface of single cylinder and have electrical conductivity; and a seal member that is arranged in abutting contact with the surface of the toner carrier roller moving from outside the housing toward inside the housing at a position downstream of an opposed position in a rotation direction of the toner carrier roller to prevent toner leakage from the housing, a contact surface of the seal member being made of a material obtained by dispersing electrically conductive particles in a fluororesin base material.

2. The developing device according to claim 1, wherein grain size of the resin base material is equal to or smaller than the length of the respective convex sections in a direction parallel to the rotational axis of the toner carrier roller.

3. The developing device according to claim 1, wherein an elevation difference between the convex sections and the concave section is equal to or larger than a volume average particle diameter of the toner.

4. The developing device according to claim 1, wherein, on the toner carrier roller surface, inclination of slants connecting the convex sections and the concave section is larger at a front side than at a rear side in a moving direction of the surface according to the rotation of the toner carrier roller.

5. The developing device according to claim 1, further comprising a restricting member that restricts toner adhesion to top surfaces of the convex sections by coming into contact with the surface of the toner carrier roller at a position upstream of a contact position of the toner carrier roller and the seal member in the rotation direction of the toner carrier roller.

6. The developing device according to claim 1, wherein top surfaces of the respective convex sections are electrically connected to each other.

7. An image forming apparatus, comprising:

a latent image carrier that carries an electrostatic latent image;

a housing that stores toner inside;

a toner carrier roller that is shaped approximately like a cylinder, is mounted to the housing rotatably about a rotational axis, rotates while carrying the toner on a surface thereof to convey the toner to an opposed position to the latent image carrier outside the housing, and is provided, on the surface thereof, with a plurality of convex sections which are regularly arranged and a concave section which surrounds the convex sections, the convex sections including top surfaces that coincide with a part of a curved surface of single cylinder and have electrical conductivity; and a seal member that is arranged in abutting contact with the surface of the toner carrier roller moving from outside the housing toward inside the housing at a position downstream of the opposed position in a rotation direction of the toner carrier roller to prevent toner leakage from the housing, a contact surface of the seal member being made of a material obtained by dispersing electrically conductive particles in a fluororesin base material.

8. The image forming apparatus according to claim 7, wherein an operation mode is executed in which the seal member abuts on the toner carrier roller while the toner carrier being rotated without the toner being carried at least on the convex sections of the toner carrier roller surface.

9. An image forming method, comprising:

causing a toner carrier roller to carry toner stored in a housing, the toner carrier roller being shaped approximately like a cylinder and being provided, on a surface thereof with a plurality of convex sections which are arranged regularly and a concave section which surrounds the convex sections, the convex sections including top surfaces that coincide with a part of a curved surface of single cylinder and have electrical conductivity;

rotating the toner carrier roller to convey the toner to an opposed position facing a latent image carrier that carries an electrostatic latent image, thereby developing the electrostatic latent image with the toner; and bringing a seal member into abutting contact with the surface of the toner carrier roller at a position downstream of the opposed position in a rotation direction of the toner carrier roller, thereby collecting the toner into the housing, a contact surface of the seal member being made of a material obtained by dispersing electrically conductive particles in a fluororesin base material.

* * * * *